US010384848B2

(12) United States Patent
Barbaroux et al.

(10) Patent No.: US 10,384,848 B2
(45) **Date of Patent: *Aug. 20, 2019**

(54) 3D CONTAINER WITH RIGID FRAME, DEFORMABLE CONTAINER AND FUNCTIONAL MEANS FOR PROCESSING THE CONTENT AND INCLUDING AN INNER MEMBER FOR BIOPHARMACEUTICAL APPLICATIONS

(71) Applicant: SARTORIUS STEDIM FMT SAS, Aubagne (FR)

(72) Inventors: Magali Dominique Corinne Barbaroux, La Destrousse (FR); Eric Chevalier, Paris (FR); Isabelle Valerie Christine Gay, Peypin (FR)

(73) Assignee: SARTORIUS STEDIM FMT SAS, Aubagne (FR)

( * ) Notice: Subject to any disclaimer, the term of this patent is extended or adjusted under 35 U.S.C. 154(b) by 377 days.

This patent is subject to a terminal disclaimer.

(21) Appl. No.: 14/990,813

(22) Filed: Jan. 8, 2016

(65) Prior Publication Data

US 2016/0114951 A1 Apr. 28, 2016

Related U.S. Application Data

(63) Continuation of application No. 12/920,888, filed as application No. PCT/FR2009/050313 on Feb. 27, 2009, now Pat. No. 9,266,669.

(30) Foreign Application Priority Data

Mar. 28, 2008 (FR) ..... 08 01699

(51) Int. Cl.
*B01F 7/16* (2006.01)
*B01F 15/00* (2006.01)
(Continued)

(52) U.S. Cl.
CPC ..... *B65D 77/06* (2013.01); *A61J 1/05* (2013.01); *B01F 7/163* (2013.01);
(Continued)

(58) Field of Classification Search
CPC .... B65D 77/06; B65D 21/086; B65D 90/205; B65D 88/68; B65D 37/00; B65D 88/16;
(Continued)

(56) References Cited

U.S. PATENT DOCUMENTS 2,958,517 A * 11/1960 De Long ..... B01F 13/0827 366/273
3,647,397 A * 3/1972 Coleman ..... B01F 13/0818 366/167.1
(Continued)

FOREIGN PATENT DOCUMENTS

DE 1301970 8/1969
DE 2017472 4/1970
(Continued)

OTHER PUBLICATIONS

Machine translation of DE1301970, provided by esp@cenet (retrieved Oct. 4, 2012).
(Continued)

*Primary Examiner* — Charles Cooley
(74) *Attorney, Agent, or Firm* — Young & Thompson

(57) ABSTRACT

A frame delimits an inside space and includes a peripherally closed side wall and two transverse openings or one transverse opening and a transverse end wall. It is capable of allowing the airtight engagement of the open free edge of a side wall in film form of a receptacle that is at least partially deformable. It is specially designed for the creation of a 3D container. The frame is also able to act as a support for at least one functional port or attachment port of a functional element. Its axial size is adequate for delimiting a space of
(Continued)

a size that is at least equal to the axial dimension of the functional element, so that the latter can be completely housed within the inside space.

14 Claims, 8 Drawing Sheets

(51) Int. Cl.

| | |
|---|---|
| ***A61J 1/05*** | (2006.01) |
| ***B65D 21/08*** | (2006.01) |
| ***B65D 37/00*** | (2006.01) |
| ***B65D 77/06*** | (2006.01) |
| ***B65D 88/16*** | (2006.01) |
| ***B65D 88/68*** | (2006.01) |
| ***B65D 90/20*** | (2006.01) |

(52) U.S. Cl.
CPC .... *B01F 15/0085* (2013.01); *B01F 15/00831* (2013.01); *B65D 21/086* (2013.01); *B65D 37/00* (2013.01); *B65D 88/16* (2013.01); *B65D 88/68* (2013.01); *B65D 90/205* (2013.01)

(58) Field of Classification Search
CPC .... B65D 83/0055; A61J 1/05; B01F 15/0085; B01F 7/163; B01F 15/00831; B01F 7/162; B01F 2215/0032; C12M 27/02; C12M 23/14; C12M 23/00
USPC ..... 366/273–274, 314, 348, 117, 118, 315, 366/317, 322–335; 435/302.1; 604/416, 604/903; 383/127; 416/3; 206/219–221, 206/818; 215/DIG. 3, DIG. 8
See application file for complete search history.

(56) References Cited

U.S. PATENT DOCUMENTS

| | | | | |
|---|---|---|---|---|
| 4,015,635 | A | 4/1977 | Goransson | |
| 4,559,053 | A | 12/1985 | Porges | |
| 4,759,635 | A | 7/1988 | MacMichael et al. | |
| 5,750,440 | A * | 5/1998 | Vanell | B01F 13/0818 156/345.12 |
| 5,941,635 | A * | 8/1999 | Stewart | B01F 5/0068 366/165.5 |
| 5,988,422 | A | 11/1999 | Vallot | |
| 6,071,005 | A * | 6/2000 | Ekambaram | B01F 5/0068 366/165.1 |
| 6,186,932 | B1 * | 2/2001 | Vallot | A61J 1/05 493/189 |
| 6,494,613 | B2 | 12/2002 | Terentiev | |
| 7,153,021 | B2 * | 12/2006 | Goodwin | B01F 13/0818 366/273 |
| 7,249,880 | B2 | 7/2007 | Zambaux | |
| 7,278,780 | B2 * | 10/2007 | Goodwin | B01F 13/0818 366/273 |
| 8,292,491 | B2 * | 10/2012 | Castillo | B01F 3/1221 366/273 |
| 8,690,129 | B2 | 4/2014 | Ludwig et al. | |
| 8,746,964 | B2 * | 6/2014 | Castillo | B01F 3/1221 366/273 |
| 8,845,182 | B2 * | 9/2014 | Bernard | B01F 7/162 206/219 |
| 9,073,023 | B2 * | 7/2015 | Bernard | B01F 3/1207 |
| 9,266,669 | B2 * | 2/2016 | Barbaroux | B01F 7/163 |
| 9,808,780 | B2 * | 11/2017 | Cutting | B01F 15/0048 |
| 2003/0029982 | A1 | 2/2003 | Hurst et al. | |
| 2004/0190372 | A1 * | 9/2004 | Goodwin | B01F 13/0818 366/273 |
| 2005/0249033 | A1 | 11/2005 | Krause | |
| 2006/0131765 | A1 | 6/2006 | Terentiev et al. | |
| 2006/0176772 | A1 * | 8/2006 | Goodwin | B01F 13/0818 366/273 |
| 2007/0224676 | A1 | 9/2007 | Haq | |
| 2007/0253287 | A1 * | 11/2007 | Myhrberg | B01F 7/162 366/273 |
| 2008/0008028 | A1 | 1/2008 | Terentiev et al. | |
| 2008/0011759 | A1 | 1/2008 | Hsu | |
| 2010/0215290 | A1 * | 8/2010 | Castillo | B01F 3/1221 383/38 |
| 2010/0220547 | A1 * | 9/2010 | Bernard | B01F 7/162 366/150.1 |
| 2011/0038222 | A1 | 2/2011 | Ludwig et al. | |
| 2011/0044567 | A1 * | 2/2011 | Barbaroux | B01F 7/163 383/120 |
| 2011/0158037 | A1 * | 6/2011 | Bernard | B01F 3/1207 366/173.2 |
| 2012/0155216 | A1 | 6/2012 | Morrissey et al. | |
| 2014/0369157 | A1 * | 12/2014 | Bernard | B01F 7/162 366/177.1 |
| 2016/0114951 | A1 * | 4/2016 | Barbaroux | B01F 7/163 220/9.2 |
| 2018/0223233 | A1 * | 8/2018 | Nanba | |

FOREIGN PATENT DOCUMENTS

| | | | |
|---|---|---|---|
| DE | 2017472 A1 * | 11/1971 | B01F 13/0827 |
| DE | 202006003886 | 5/2006 | |
| EP | 0559337 | 9/1993 | |
| EP | 1842800 | 10/2007 | |
| FR | 2781202 | 1/2000 | |
| FR | 2921905 | 4/2009 | |
| JP | 4072187 | 3/1992 | |
| WO | 2008040569 | 4/2008 | |

OTHER PUBLICATIONS

International Search Report, dated Oct. 9, 2009, from corresponding PCT application.

* cited by examiner

3D CONTAINER WITH RIGID FRAME, DEFORMABLE CONTAINER AND FUNCTIONAL MEANS FOR PROCESSING THE CONTENT AND INCLUDING AN INNER MEMBER FOR BIOPHARMACEUTICAL APPLICATIONS

BACKGROUND OF THE INVENTION

Field of the Invention

The invention relates to a 3D container (D for dimension), comprising a rigid frame, a deformable receptacle, and a functional means for treatment of the contents, including an internal element that is located inside the container, especially designed for shipping, storage or treatment of biopharmaceutical fluids. The invention also relates to a unit that comprises such a container and a rigid support that can ensure that it is held.

Description of the Related Art

Flexible pouches for medical use that have two large flexible walls joined at their periphery have been known for a long time. Such pouches, once expanded, remain relatively thin, which justifies the fact that they are often called "pillow" pouches or "2D" pouches (D meaning dimension). Such a small-capacity 2D pouch for individual and one-time use is described according to a particular embodiment in the document U.S. Pat. No. 4,559,053. In this embodiment, the pouch comprises two foldable films made of plastic material and a semi-rigid frame that has a central opening, whereby the two films are welded on the two large surfaces of the semi-rigid frame, through whose wall passes the input/output ports. The invention does not relate to the 2D containers or pouches.

The document FR-A-2 781 202 describes a container that has two large walls and two side gussets. Each gusset comprises two small walls that are connected to one another by an inside fold, and each small wall is connected to the adjacent large wall by an outside fold. Such a container, once expanded, assumes a three-dimensional shape (cylindrical, prismatic, parallelepipedic, . . . ) and can have a volume of 50 liters and even more, which justifies the fact that it is termed 3D.

In the case of a 3D container that is intended in the biopharmaceutical field to be substituted for a traditional stainless steel tank, it is desirable to transfer functions previously executed in the tank to the flexible container. This problem is not posed in the case of 2D containers or pouches. In addition to the input and output of the contents of the container or components of its contents, these functions are typically mixing, aeration, measuring (collecting) data, and pumping. The execution of such functions requires using devices that comprise one or more elements that are solid and that take up a certain amount of space, with more or less simple or distorted shapes, that may or may not be rigid, stationary or mobile, in particular forming part of the group that comprises the rods, shafts, propellers or mixing elements, aerators, pipes . . . placed in the container itself.

The document US-A-2006/0131765 describes a container that is used as a bioreactor, designed to accommodate contents in the fluid state. This container comprises a flexible or non-rigid part and a rigid part. According to the embodiments, the container is open or closed hermetically, and it comprises one or more input/output ports. The rigid part forms a small plate and comprises a protuberance that is located in the container. The rigid part is used as a support for an internal element for treatment of the contents of the container, such as a mixing element or an aerator. Such an embodiment exhibits the drawback that an internal element that is solid and that takes up a certain amount of space, with a more or less simple or distorted shape (with pointed or sharp-edged contours), rigid or non-rigid, stationary or mobile, can damage the flexible part that is made of plastic film if they come into contact with one another.

The document US-B2-6494613 describes a mixing container that is designed to accommodate contents in the fluid state. This container comprises a flexible bag and a sheath or flexible tube that passes through the wall of the bag hermetically and is housed in the bag. An essentially rigid rod of predetermined shape is placed in the sheath or tube and projects from the bag. It is driven by an engine. Such an embodiment exhibits the drawback of being complex and having limited scope, for example ill-suited in the case of a functional means for treatment of the contents of the container, such as a means for mixing, aeration, measuring (collecting) data, and pumping.

The document US-B2-7249880 describes an embodiment of the same type as the preceding one.

Furthermore, the document US-A-2003/0029982, whose object is a large-capacity (or three-dimensional) flexible container for shipping, storage and distribution of liquids, in this case therapeutic fluids or fluids for other medical applications, describes a system for suspension and a system for support for such a container.

Foldable containers of the type comprising one or more rigid frames and a wall that is attached to this—or these—frames are known (see, for example, the document US-A-2008/0011759). However, such containers are not suitable for being able to constitute 3D containers, sterile for single use, for biopharmaceutical fluids that have to accommodate functional means for treatment of the contents of the container, such as a means for mixing, aeration, measuring (collecting) data, and pumping.

The document DE-A-1 301 970 describes a container that comprises a receptacle that has a flexible side wall that has an open free edge that is deformable so as to be able to be in two extreme states, respectively folded flat on itself and expanded in volume, and one or more rigid frames that are hollow and that comprise a transverse opening that is delimited by a side wall that is closed peripherally on itself with which the open free edge of the side wall is made integral. An upper rigid frame and a lower rigid frame comprise a transverse wall opposite the transverse opening. An intermediate rigid frame comprises two opposite transverse openings. In its transverse wall, the upper rigid frame comprises a filling opening and an air vent. Such a container is not suitable per se for shipping, storage or treatment of biopharmaceutical fluids when it is necessary to provide, in the very container, the presence of one or more elements that are solid and that take up a certain amount of space, with shapes that are more or less simple or distorted (with pointed or sharp-edged contours), that may or may not be rigid, stationary or mobile, in particular forming part of the group that comprises rods, shafts, propellers or mixing elements, aerators, pipes, . . . .

Finally, containers that have a large capacity but that are not suitable in the case of biopharmaceutical fluids and do not provide the presence in the container of one or more elements, such as those that were just mentioned, are known (JP-A-04072187, DE-U-20 2006 003 886 and EP-A-0 559 337).

There is therefore a need for sterile, disposable 3D containers, typically for the biopharmaceutical field, designed to contain biopharmaceutical fluids, which are flexible—at least partially, with large capacities—so as to be able to be substituted in traditionally used rigid tanks and which can integrate functional means for treatment of the contents of the container, for example a means for mixing, aeration, measuring (collecting) data, and pumping. There is a need for 3D containers of this type that also are easy to produce, have an acceptable cost in relation to their use, are easy in their logistical management in particular because of their polyvalence, and finally are free from the risk of damage during storage or shipping because of the presence in the container itself of one or more elements that are solid and that take up a certain amount of space, with more or less simple or distorted shapes (in particular with pointed or sharp-edged contours), rigid or not, stationary or mobile, such as those that are part of the group that comprises rods, shafts, propellers or mixing elements, aerators, pipes, . . . . There is also the requirement that the containers of this design can be presented in several different embodiments that can meet the various needs.

BRIEF SUMMARY OF THE INVENTION

The object of the invention is to overcome the problems of the known 3D containers and to meet these needs.

For this purpose, the invention proposes a large-capacity container that is designed for fluid contents, comprising:

At least one receptacle that has at least one side wall made of flexible film and having an open free edge, at least partially deformable so as to be able to be in two extreme states, respectively folded flat on itself (storage of the empty container) and expanded in volume (filling of the container with contents), At least one rigid, hollow frame, comprising a first transverse opening that is delimited by a side wall that is closed peripherally on itself with which the open free edge of the side wall is made integral in an airtight manner, In which, The container also comprises at least one functional means for treatment of the contents including at least one internal element that is inside the container, A frame that comprises a second transverse opening or a transverse end wall that is located opposite the first transverse opening, The at least one frame supports at least one connection port of the at least one functional treatment means, The at least one internal element is housed in an inside space that is delimited by at least one side wall of at least one frame, whereas the at least one receptacle is in the state where it is folded flat or expanded in volume, With the container being specially adapted to constitute a sterile, disposable container with a large capacity, designed for storage, shipping or treatment of biopharmaceutical fluid.

According to the embodiments, a connecting port is a pass-through, including a through hole, or, in contrast, is not a pass-through and is located inside the inside space delimited by the frame.

According to one embodiment, the container comprises at least two connecting ports that are arranged opposite one another on either side of the container.

According to one embodiment, the container also comprises at least one input/output port.

According to the embodiments, a port is located on the side wall or on the transverse end wall of the frame.

According to a first embodiment, the at least one internal element is housed in an inside space that is delimited by the side wall of a single frame. According to a second embodiment, the at least one internal element is housed in an inside space that is formed by the two inside spaces opposite the two frames facing one another.

According to a first embodiment, the—or at least a portion of the—side wall of the receptacle is located essentially in the extension of the shell that forms the side wall of the frame. According to a second embodiment, the—or at least a portion of the—side wall of the receptacle is located transversely apart from the shell that forms the side wall of the frame.

According to the embodiments, the side wall of the receptacle is arranged in a foldable and expandable accordion or with foldable and expandable gussets.

According to the embodiments, the functional means for treatment of the contents is a mixing means, an aeration means, a means for measuring (collecting) data, or a pumping means.

According to the embodiments, the internal element of the functional means for treatment of the contents belongs to the group that comprises rods, shafts, propellers or mixing elements, aerators, and pipes.

According to one embodiment in the case where the container comprises two transverse openings on either side of the side wall, the airtight engagement with the side wall, around each of the two transverse openings, with the free edge of a receptacle, is provided, whereby the container comprises the frame and the two receptacles in communication with one another and located on either side of the frame.

According to one embodiment in the case where the container comprises two transverse openings on either side of the side wall, there is also provided a transverse median wall that is located between the two transverse openings that have an airtight bonding with the side wall, whereby the side wall is formed by two side sub-walls, each associated with each of the two transverse openings, whereby the container comprises the frame and the two receptacles, and whereby without communication with one another, they are separated by the transverse median wall and are located on either side of the frame that forms two back-to-back sub-frames.

According to one embodiment in the case where the container comprises a transverse opening on either side of the side wall and a transverse end wall, the airtight engagement with the side wall, around the transverse opening, of the free edge of a receptacle is provided, the container comprising the frame and a receptacle located beside the frame where the transverse opening is located.

In this last embodiment and according to a variant, the container also comprises a second receptacle that is located beside the frame where the transverse end wall is found, whose open free edge is integrated, in an airtight manner, around said transverse end wall.

According to the embodiments, the two receptacles are either identical or similar or different, in particular by their capacities.

According to the embodiments, the component parts of the frame are an integral part of the frame either to be brought into production together or to be assembled and integrated.

According to the embodiments, a transverse median wall or a transverse end wall is either rigid (flat or curved) or deformable (elastic or inelastic).

According to the embodiments, a transverse median wall or a transverse end wall, with the side wall of the frame, has a rigid bonding or a flexible bonding.

According to one embodiment, the frame is made of plastic material.

According to one embodiment, the container is opaque, whereby the functional treatment means is sensitive to light.

According to a first embodiment, a receptacle is integrally deformable, being made in the form of a plastic film pouch. According to a second embodiment, a receptacle is partially deformable, being made in the form of a sheath or sleeve made of plastic film, and partially not deformable, including a rigid part in the form of a plate. In this case, and according to one embodiment, the rigid part in the form of a plate is located opposite the frame. According to one embodiment, the rigid part in the form of a plate is a transverse end wall or a transverse median wall that is part of a frame.

According to another aspect, the purpose of the invention is a container whose receptacle(s) contain(s) one or more biopharmaceutical fluid(s).

According to another aspect, the purpose of the invention is a unit comprising, on the one hand, a 3D container as it was described above, and, on the other hand, a rigid support that can ensure that the container is held.

BRIEF DESCRIPTION OF THE DRAWINGS

Several embodiments of the invention and different variants will now be described using the drawings in which:

FIG. 10 shows, on the one hand, on the transverse end wall of a lower frame, a non-pass-through connection port that accommodates an internal element of the functional treatment means, here a mixing element, and an input/output port, on the other hand, on the transverse end wall of an upper frame, an input/output port, and finally a receptacle whose side wall, located in the extension of the shell that forms the side wall of each of the two frames, placed at each of the two lower and upper ends, is arranged with foldable gussets, expanded here.

FIG. 12 shows, on the one hand, on the transverse end wall of a lower frame, a non-pass-through connection port that accommodates an internal element of the functional treatment means, here a mixing element, and two input/output ports, on the other hand, an upper frame that lacks the connection port or input/out port, and finally a receptacle whose side wall, located transversally apart from the shell that forms the side wall of each of the two frames, placed at each of the two lower and upper ends, is arranged with foldable gussets, expanded here.

DETAILED DESCRIPTION OF THE PREFERRED EMBODIMENTS

Figure 1:
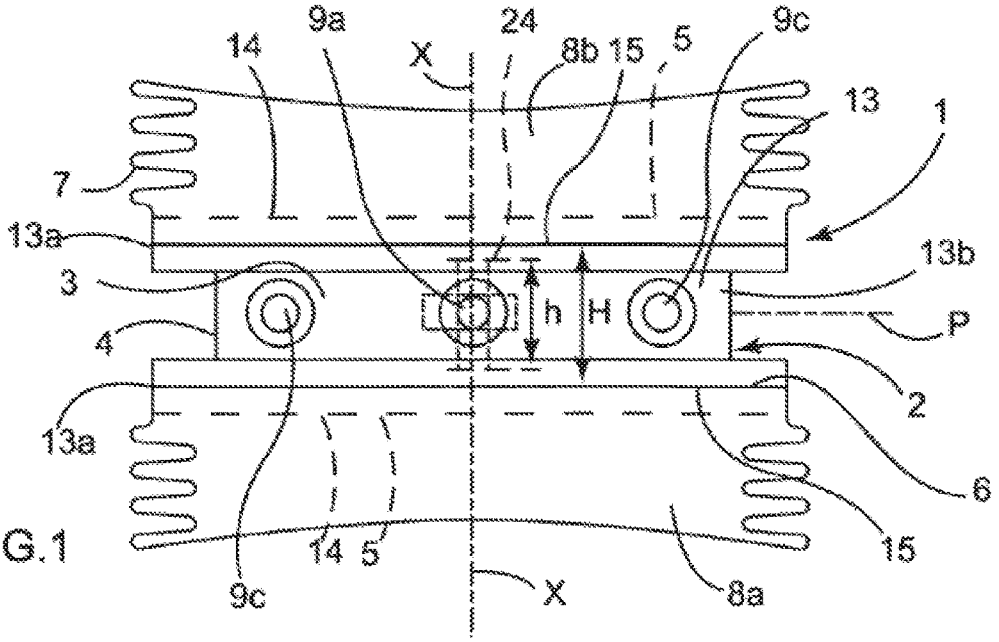
FIG. 1 is an elevation view of a 3D container according to a first embodiment with two receptacles that communicate with one another, folded on themselves and against the frame with two transverse median-mounted openings, the figure showing three ports passing through the side wall of the frame, an internal element of a functional means for treatment of the contents of the container, here a mixing element, and two receptacles whose side walls, located in the extension of the shell that forms the side wall of the frame, are arranged like an accordion and folded here.

A container 1 that is flexible (at least partially) and with large capacity (or 3D, according to the terminology of the art) is designed to be substituted for a rigid tank such as the ones traditionally used in the biopharmaceutical field. Very specially, this container 1 can be sterilized, is disposable, and is able to accommodate a biopharmaceutical fluid. Such a container 1 is specially designed for shipping, storage or treatment of the biopharmaceutical fluid that it contains.

According to the applications, the container 1 is closed or open, and, if necessary, provided with input/output ports 9*c* that are necessary to its operation, such as one or more ports for filling the container 1 with its contents or the components of its contents and one or more drainage ports that are preferably placed in the lower position of the container 1.

The container 1 first comprises a rigid, hollow frame 2 that delimits an inside space 3.

The frame 2 comprises a side wall 4 that is closed peripherally on itself. On at least one side of the side wall 4, the frame 2 comprises a transverse opening 5.

The container 1 has a primary XX axis that is orthogonal to the primary plane P of the frame 2.

In the drawings, the XX axis is shown vertical, which corresponds to a position of use of the container 1, when the latter contains contents. The frame 2 then extends horizontally, the plane P being horizontal.

According to other variants, not shown, the XX axis is arranged horizontally. In this case, the frame 2 extends vertically, the plane P being vertical.

If necessary, the relative position of the container 1 relative to the horizontal and to the vertical is changed during the process of use of the container 1. For example, it passes from one vertical arrangement to the horizontal or vice versa.

Secondly, the container 1 comprises two side walls 7 in the form of film, made integral with it in an airtight manner by each of its two free open edges 6 and constituting or being part of two receptacles 8 that are at least partially deformable.

These two receptacles 8 are placed on either side of the frame 2, along the XX axis, one 8*a* in the lower part and the other 8*b* in the upper part.

In one embodiment, the receptacle 8 is inelastic or substantially inelastic, which does not rule out that it can be either folded or expanded. In another embodiment, the receptacle 8 has a certain extension capacity.

A film such as the one that is used for the creation of the receptacle 8 is typically made of single-layer or multi-layer thermoplastic polymers.

In a first embodiment (FIGS. 1 to 3), the frame 2 comprises two transverse openings 5 on either side of the side wall 4. Thus, the side wall 4 is able to allow the airtight engagement around each of the two transverse openings 5 of the open free edge 6 of a side wall 7 of a receptacle 8 in the general shape of a bag or a pouch. In this first embodiment, the frame 2 is thus specially designed for the creation of a 3D container 1, comprising, in addition to the frame 2, the receptacles 8, 8*a* and 8*b* in communication with one another by the two transverse openings 5 and located on either side of the frame 2.

The side wall 4 of the frame 2, according to this first embodiment, satisfies several functions.

The first function of the side wall 4 is to ensure the airtight engagement, around a transverse opening 5, of the free edge 6 of the side wall 7 of the receptacle 8. In this way, it is possible to produce an airtight container 1 that has the rigid frame 2 and the two deformable receptacles 8.

The second function of the side wall 4 is to support or to include at least one pass-through connection port 9*a* or at least one non-pass-through connection port 9*b*, and, if necessary, at least one input/output port 9*c*.

Figure 3:
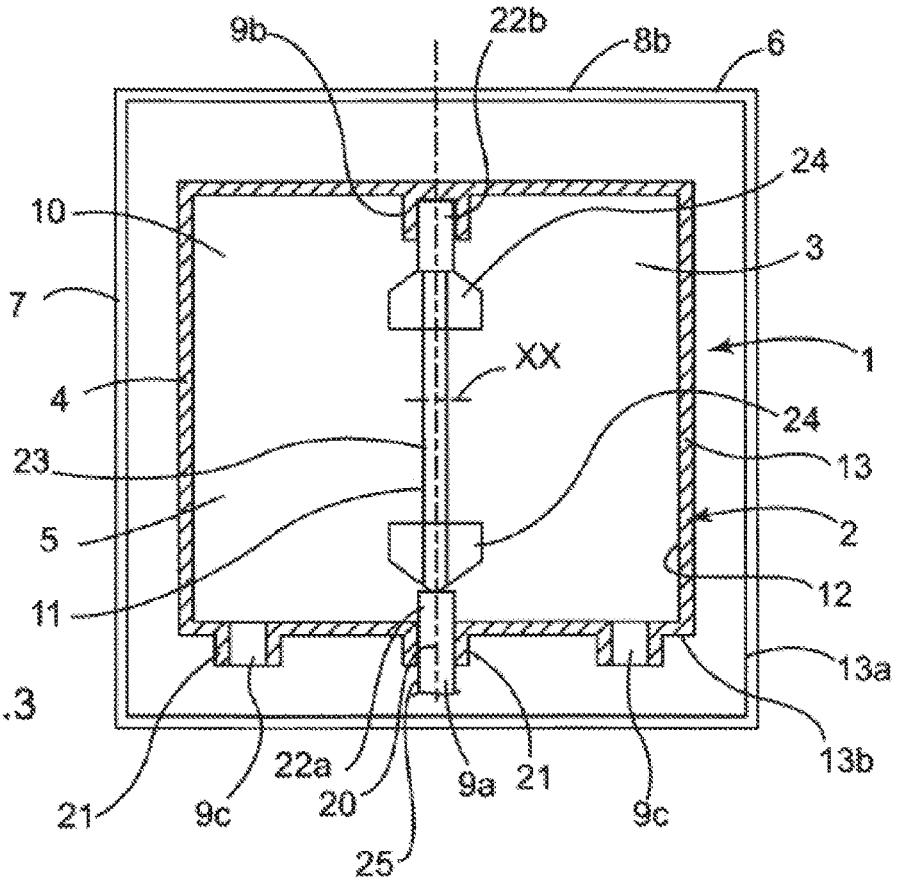
FIG. 3 is a cutaway view along line of FIG. 2, corresponding to a transverse plane, illustrating the frame and the functional means for treatment of the contents of the container, here a mixing element, the figure showing, on the one hand, the internal element of the functional means for treatment, here a shaft and two mixing elements, housed in the inside space of the rigid frame, and, on the other hand, arranged on the side wall of the frame, three pass-through ports and one non-pass-through port for connection arranged in relation to a pass-through port for connection, on either side of the container, holding the shaft of the functional treatment means, whereby the two other ports are input/output.
Figure 2:
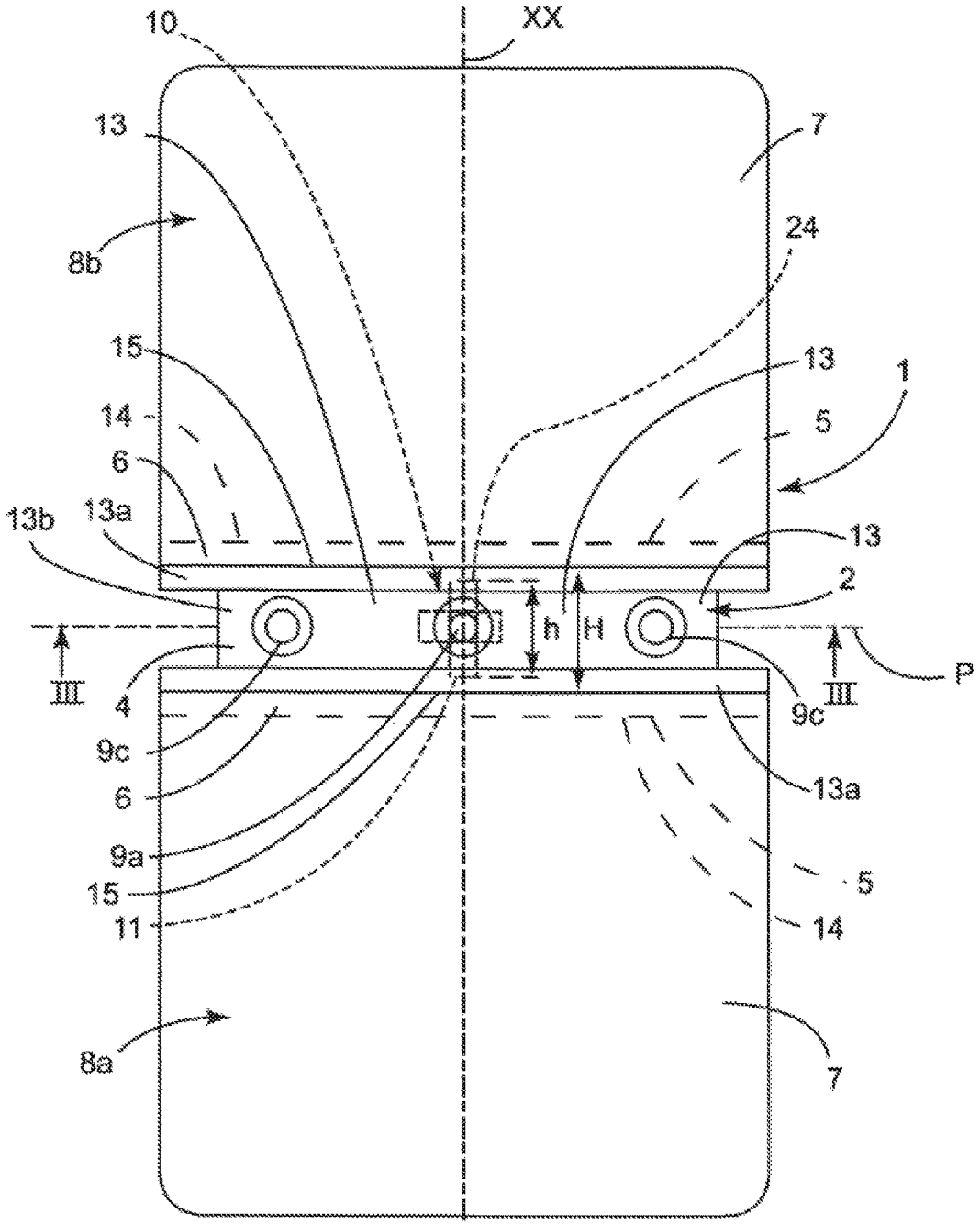
FIG. 2 is an elevation view that is similar to that of FIG. 1, whereby the two receptacles are expanded in volume so as to be able to accommodate contents, the figure showing the three ports that pass through on the side wall of the frame, the internal element of the functional means for treatment of the contents of the container, here a mixing element, and side walls of the containers that are located in the extension of the shell that forms the side wall of the frame.

In the first embodiment of FIGS. 1 to 3, the container 1 comprises, on one side, three pass-through ports, namely a connection port 9*a* and two input/output ports 9*c*, and, on the opposite side, a non-pass-through port 9*b* that is located opposite the pass-through connection port 9*a*.

Here, "port" means a means for connection or physical bonding as described below.

The purpose of such a physical connection means can be, in a first possibility, to ensure a function of holding an element, where the form of this holding can be varied and the degree of this holding can be more or less significant: attachment, rotating or sliding support, centering, . . . whereby this list is not exhaustive.

In this case, and according to a first variant, such a physical connection means can be a pass-through, the port being designated a "pass-through connection port" 9*a* (FIG. 3 in the lower part). Such a pass-through connection port 9*a* includes a through hole 20 that is made in the wall that supports—or in which is included—the port, here the side wall 4. Such a pass-through connection port 9*a* usually comprises a part 21 that projects toward the outside. Such a pass-through connection port 9*a* can come in the form of a hollow or similar bearing, whereby this list is not exhaustive.

According to a second variant, such a physical connection means can be a non-pass-through, whereby the port is designated "non-pass-through connection port" 9*b* (FIG. 3 in the upper part and FIGS. 9, 11, 13 and 14). Such a non-pass-through connection port 9*a* can come in the form of a stud, a bearing, a rod, a cavity, a projection, or the like, located inside the inside space 3 that is delimited by the frame 2, whereby this list is not exhaustive.

In this case, such a pass-through connection port 9*a* or a non-pass-through connection port 9*b* is designed to hold an element 11 that is part of a functional treatment means 10.

The purpose of such a physical connection means can be, in a second possibility, to ensure a function of passage and communication of material (such as the contents of the container or the components of its contents), whereby the port is designated "input/output port" 9*c*.

Such an input/output port 9*c* is able to make possible the filling of the container 1 with its contents or the components of its contents, or its draining.

In its second function, the side wall 4 of the frame 2 supports or includes one or more ports, including at least one pass-through connection port 9*a* or non-pass-through connection port 9*b*. If necessary, the side wall 4 supports several pass-through connection ports 9*a* and/or non-pass-through connection ports 9*b*. The container 1 can thus hold the internal element 11 of the functional treatment means 10. If necessary, the container 1 holds several internal elements 11 of the same or several functional treatment means 10.

In addition, the side wall 4 of the frame 2 can support or include, in addition to the pass-through connection port(s) 9*a* or non-pass-through connection port(s) 9*b*, one or more input/output ports 9*c*.

These ports 9*a*, 9*b*, 9*c* extend in directions orthogonal to the XX axis, in this case in horizontal directions.

The third function of the side wall 4, according to this same first embodiment of FIGS. 1 to 3, is to be able, because of its outside axial size H, to delimit an inside space 3 with an axial size that is at least equal to the axial dimension h of the internal element 11.

Thus, the internal element 11 can be completely—or essentially completely—housed in this inside space 3, which makes it possible to prevent the risk of damage of the container 1 as a result of the presence in the container 1 itself of one or more internal elements 11 that are solid and that take up a certain amount of space, with more or less simple or distorted shapes (in particular with pointed or sharp-edged contours), rigid or not, stationary or mobile. The frame 2 thus acts as protective housing for the internal element 11, but also for the receptacle 8.

Thirdly, the container 1 comprises the functional treatment means 10 of the contents that are in the container 1, namely the biopharmaceutical fluid, associated with the container 1. If necessary, the container 1 comprises several functional treatment means 10 for the same function or different functions.

A functional treatment means 10 such as the one that is considered here is designed to execute functions that act on the contents of the container, such as typically the mixing, aeration, measurement (collection) of data by a measurement device, and pumping. These functions were conventionally executed on the traditional rigid tanks that were used up until now in the biopharmaceutical field. The functions that were just mentioned are only exemplary and in no way limiting.

The embodiment of such functions makes it necessary to use one or more elements 11 that are solid and that take up a certain amount of space, with more or less simple or distorted shapes, rigid or not, stationary or mobile. These elements 11 are part of the group that comprises rods, shafts, propellers, or mixing elements, aerators, and pipes. This list is only exemplary and in no way exhaustive.

Such an—or such—element(s) 11 are placed inside the container 1 itself; this is why the element 11 can be termed an internal element.

If necessary, an element 11 also comprises a part 25 that is located outside of the container 1 or else another element 25 that extends the element 11 and is located outside of the container 1, forming part of the functional treatment means 10. Such a part or element 25 can be part of the group that comprises rods, shafts, pipes, engines, supply tube, drain, instrumentation, . . . , whereby this list is only exemplary and in no way exhaustive.

In the first embodiment that is shown in FIGS. 1 to 3, the two ports 9*a* and 9*b* facing one another form bearings and hold the two end parts 22*a*, 22*b* of a shaft 23, on which are fixed rigidly the blades 24 of two mixing elements, the element 11, in terms of the patent, here comprising the shaft 23 and the blades of two mixing elements 24.

The frame 2 is typically made of plastic, rigid, being specified that in certain embodiments described below, it can comprise a flexible transverse wall.

In the embodiments shown in the figures, the frame 2, and therefore its side wall 4, has a square or rectangular contour. Other forms can be considered.

The frame 2 comprises a lower surface 12, an outside surface 13, and two side edges 14 that define, in the first embodiment of FIGS. 1 to 3, the two transverse openings 5.

In the first embodiment of FIGS. 1 to 3, the outside surface 13 of the frame 2 comprises, on the one hand, two projecting parts 13*a* that form two flanges that are directed toward the outside of the frame 2 parallel to its primary plane P and adjacent to the two side edges 14, and, on the other hand, a returning part 13*b* that is located between the two projecting parts 13*a*, extended enough in the axial direction so as to be able to make possible the arrangement of the pass-through port(s) 9*a*, 9*c*.

The inside surface 12, on its side, is extended enough in the axial direction so as to be able to make possible the arrangement of the pass-through port(s) 9*a*, 9*c* and the non-pass-through connection port 9*b*.

A pass-through port 9*a*, 9*c* usually comprises an outside projecting part 21, such as a collar, delimiting the hole 20.

A free edge 6 of the side wall 7 of the receptacle 8 is made integral with any suitable location of the frame 2, for example with a projecting part 13*a* of the outside surface 13. This engagement is done by any suitable process, such as by welding.

In the first embodiment of FIGS. 1 to 3, the inside surface 12 of the frame 2 is flat and able to allow the arrangement of the pass-through port(s) 9*b*.

In the first embodiment of FIGS. 1 to 3, the two receptacles 8*a*, 8*b* are identical or similar. Each of them has the general shape of a bag or pouch, i.e., it is closed on itself, outside of the defined opening 15 and limited by the free edge 6. The side wall 7 of each receptacle 8*a*, 8*b* is located, roughly speaking, in the extension of the shell that forms the side wall 4 of the median-mounted frame 2.

The side wall 4 is arranged like an accordion, folded here.

In the embodiment that is being considered, a port 9*a*, 9*b*, 9*c* is an integral part of the frame 2, having come from production, here, with its side wall 4.

In the first embodiment of FIGS. 1 to 3, the two receptacles 8*a*, 8*b* are completely deformable. They communicate with the inside space 3 of the frame 2 by their openings 15, merged with the two transverse openings 5 of the frame 2.

Because of its deformable nature, a receptacle 8—when it is empty of its contents—can be folded flat on itself and against the adjacent side edge 14 of the frame 2, beside the transverse opening 5 with which the receptacle 8 is associated. Such is the case of the container 1 before use, for example during storage before use, or during shipping.

Taking into account that the axial size H is at least equal to the axial dimension h, as indicated, the internal element 11 is completely housed or substantially housed in the inside space 3, and it follows that this internal element 11, even solid and taking up a certain amount of space, of a more or less simple or distorted shape (including with sharp-edged or pointed contours), rigid or not, stationary or mobile, does not run the risk of damaging the component film of the receptacles 8*a*, 8*b*, even when the container 1 is folded (FIG. 1).

Thus, the side wall 4 also acts as a spacer between an internal element 11 of the functional treatment means 10 and the component film of a receptacle 8.

When necessary, the receptacle 8 can be expanded in volume from the side of the transverse opening 5 with which the receptacle 8 is associated. Such is the case when the container 1 is to accommodate its contents or the components of its contents (FIG. 2).

In one possible variant, the frame 2 is opaque. This structural arrangement is particularly suitable in the case of functional means 10—more specifically internal elements 11—able to be sensitive to light, such as photosensitive sensors.

Figure 4:
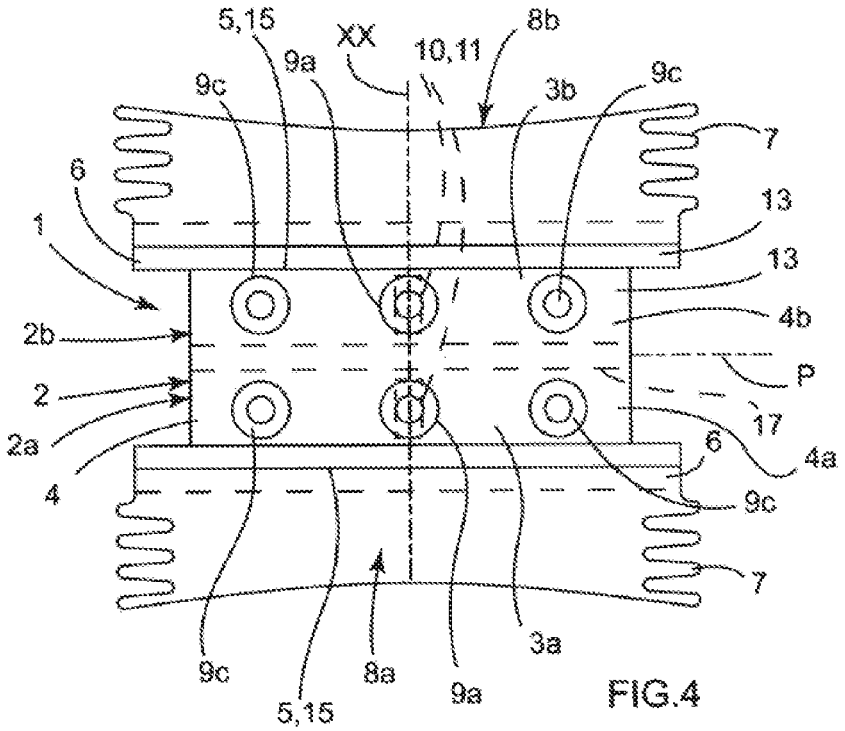
FIGS. 4, 5, 6 and 7 are four views that are similar to FIG. 1 of a second, a third, a fourth, and a fifth embodiment of the 3D container, namely: for the second embodiment, a container with two receptacles that do not communicate with one another, the median-mounted frame having two transverse openings and a transverse median wall; for the third embodiment, a container with a single receptacle, the frame placed at the upper end having a transverse opening and a transverse end wall; for the fourth embodiment, a container with two receptacles that do not communicate with one another, whereby the median-mounted frame has a transverse opening and a transverse end wall; and for the fifth embodiment, a container that has a frame and a receptacle that incorporates another frame, whereby the container has two end frames; in the four embodiments considered, the figures show ports that pass through the side wall of the frame, and receptacles whose side walls are arranged like an accordion, folded here, and located in the extension of the shell that forms the side wall of the frame.

In the second embodiment of FIG. 4, the frame 2 comprises, on either side of the side wall 4, two transverse openings 5, as in the first embodiment, but it also comprises a transverse median wall 17 that is located between the two transverse openings 5 and that has an airtight bonding with the side wall 4. The wall 17 is termed median because it is located between the two transverse openings 5.

This solid median wall 17 can, according to the variants, be rigid and, in this case, flat or, in contrast, curved—which makes it possible, for example, to form a functional cavity—or any other more or less complex shape that is desired. According to other embodiments, it can be deformable and, in this case, elastic, or, in contrast, inelastic.

With an embodiment of the frame 2 comprising such a median wall 17, the side wall 4 of the frame 2 is formed by two side subwalls 4*a* and 4*b*, one associated with each of the two transverse openings 5. The frame 2 thus forms two back-to-back subframes 2*a*, 2*b*. Such a frame 2 is thus specially designed for the creation of a container 1, closed or open, comprising, in addition to the frame 2, the two receptacles 8*a*, 8*b* that, here—and contrary to the first production described above—are without communication with one another, being separated by the solid transverse median wall 17. These two receptacles 8*a*, 8*b* are located on either side of the frame 2, as above, whereby this frame is arranged in median position. With this embodiment, the frame 2 can have, in all, an axial size that is double that of the frame 2 according to the first embodiment.

Such a frame 2 with two sub-frames 2*a*, 2*b* defines two inside spaces 3*a*, 3*b*, which are not in communication with one another, being separated by the transverse median wall 16.

The side wall 4 and the transverse median wall 17 are an integral part of the frame 2, having come from production together or having been assembled subsequently.

Figure 5:
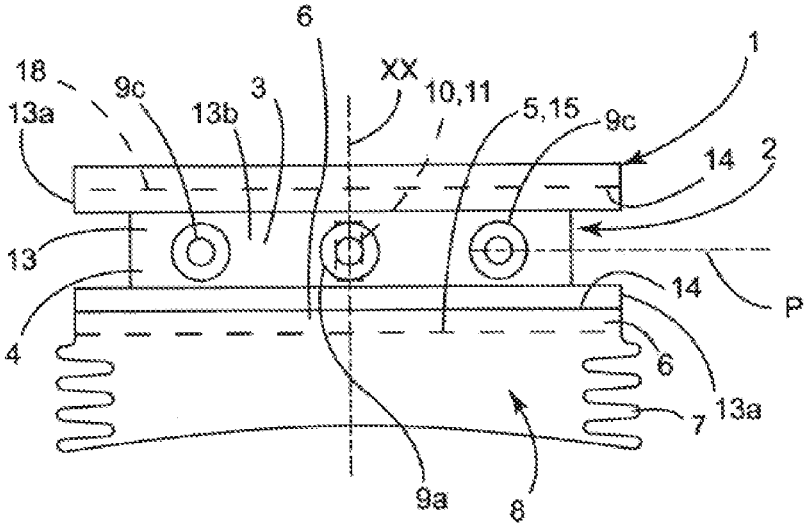

In the third embodiment of FIG. 5, the frame 2 comprises, on either side of the side wall 4, respectively, a transverse opening 5 and a transverse end wall 18. Such a frame 2 is thus specially designed for the creation of a container 1, comprising, in addition to the frame 2, a single receptacle 8 that is located on the side of the frame 2 where the transverse opening 5 is located, i.e., opposite the transverse end wall 18. The wall 18 is termed end because it is adjacent to the edge 14 of the side that is opposite to the transverse opening 5 of the frame 2.

This end wall 18 can, according to the variants, be rigid and in this case flat or, in contrast, curved—which makes it possible, for example, to form a functional cavity—or any other more or less complex shape that is desired. It can, according to other variants, be deformable and in this case elastic or, in contrast, inelastic.

Whether it is a matter of the transverse median wall 17 or the transverse end wall 18, its bonding with the side wall 4 of the frame 2 is either a rigid bonding, in particular when these walls 17, 18 are themselves rigid, or a flexible bonding.

In one variant embodiment, the transverse end wall 18 is also able to support or include one or more pass-through connection ports 9*a* and/or non-pass-through connection ports 9*b* and/or input/output ports 9*c* that are similar to those described above in relation to the side wall 4 of the frame 2. One or more ports are added or substituted—completely or only partially—to the port(s) provided on the side wall 4 of the frame 2 and described above. One or more ports 9*a*, 9*b* make it possible to hold an internal element 11 that is completely housed in the space 3.

The side wall 4 and the transverse end wall 18 are an integral part of the frame 2, having come from production together or having been assembled subsequently.

While the container 1 according to this third embodiment comprises a single receptacle 8 that is located beside the frame 2 where the transverse opening 5 is located, it can be provided, according to a variant of this third embodiment (not shown), that the container 1 comprises, in addition to this receptacle 8—constituting a "first" receptacle—, a "second" receptacle that is at least partially deformable and is located beside the frame 2 where the transverse end wall 18 is located. The open free edge 6 of the side wall of this second receptacle is made integral, in an airtight manner, around the transverse end wall 18.

When the container 1 comprises two receptacles 8*a*, 8*b*, the latter are either identical or similar or different, in particular because of their capacities.

In the embodiments described above, a receptacle 8 is integrally deformable, being made in the shape of a bag or pouch of plastic film arranged like an accordion.

Figure 6:
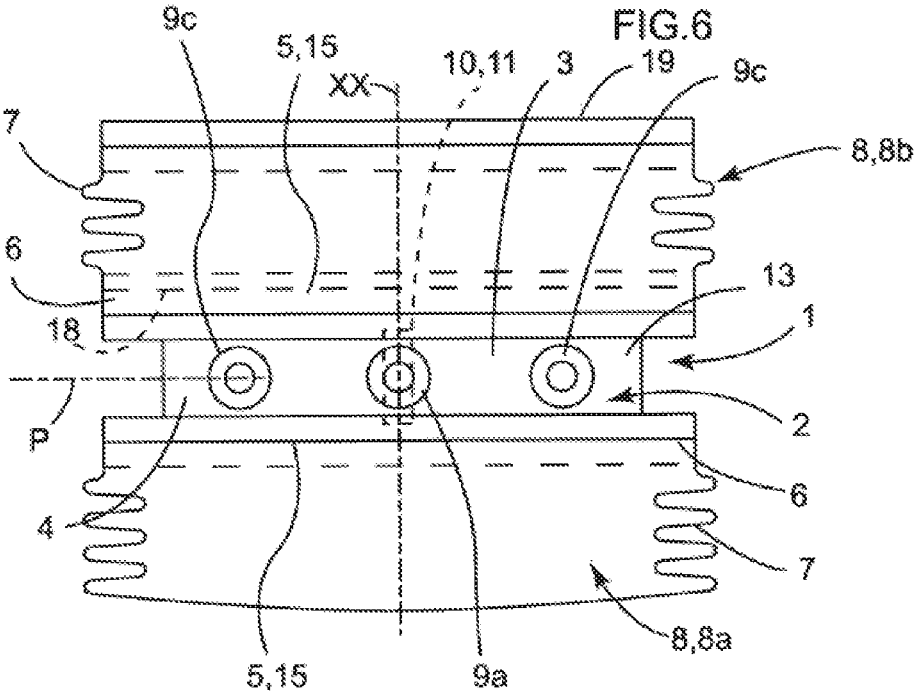

In the fourth embodiment of FIG. 6, derived from the first embodiment of FIGS. 1 to 3, one of the two receptacles, in this case the upper receptacle 8*b*, is only partially deformable, being made in the form of a sheath or sleeve in plastic film, like an accordion, as was just described, and partially non-deformable, including a rigid part 19 in the form of a plate, located opposite the frame 2 of the container 1.

According to the variants of this fourth embodiment (not shown), the rigid part 19 can consist of a transverse end wall 18 or a transverse median wall 17 that is part of a second frame 2 of the general type that is described above. The container 1 then comprises two frames 2, one median and the other end, and two receptacles 8.

Figure 7:
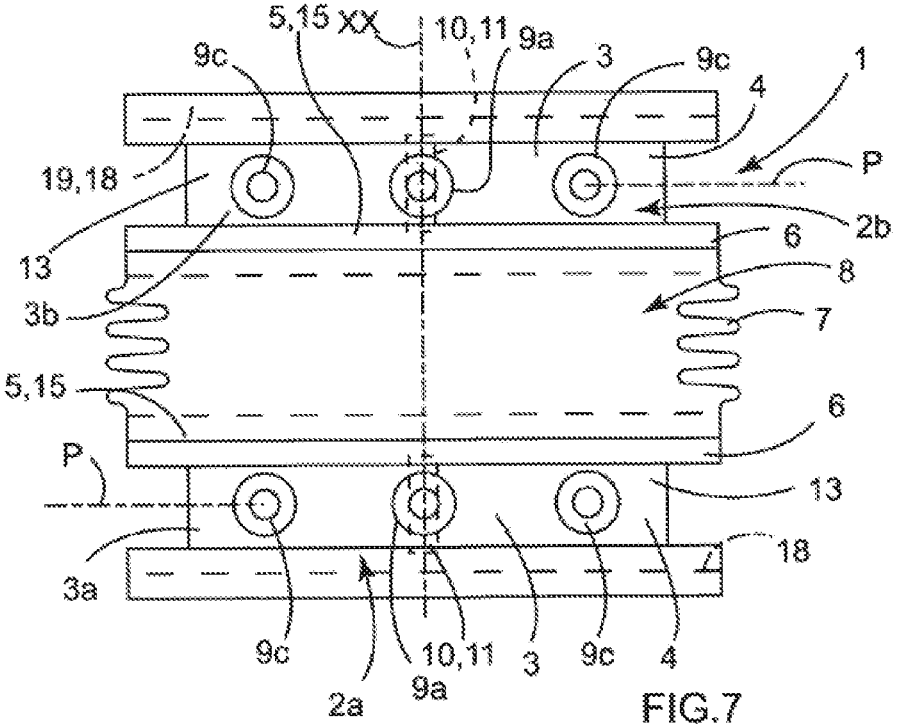

In the fifth embodiment of FIG. 7, derived from the third embodiment of FIG. 5, the receptacle 8 is only partially deformable, being made in the form of a sheath or sleeve of plastic film, like an accordion, as was just described, and partially non-deformable, including a rigid part 19 in the form of a plate, located opposite the frame 2 of the container 1, consisting of a transverse end wall 18 that is part of a second frame 2 of the general type described above. The container 1 then comprises two end frames 2, respectively 2*a* and 2*b*, facing one another, whereby the receptacle 8 is placed between the two frames 2 that are opposite and face one another by their inside spaces 3*a* and 3*b*.

When the container 1 is folded, the two spaces 3*a* and 3*b* together form a large space 3*a*+3*b*, being in communication with one another.

The two frames 2*a*, 2*b* are or are not identical. Each of these two frames 2*a*, 2*b* has a transverse end wall 18. These two frames 2*a*, 2*b* are connected by a sheath that is generally cylindrical in shape and is made of a deformable plastic film that is arranged like an accordion.

Figure 8:
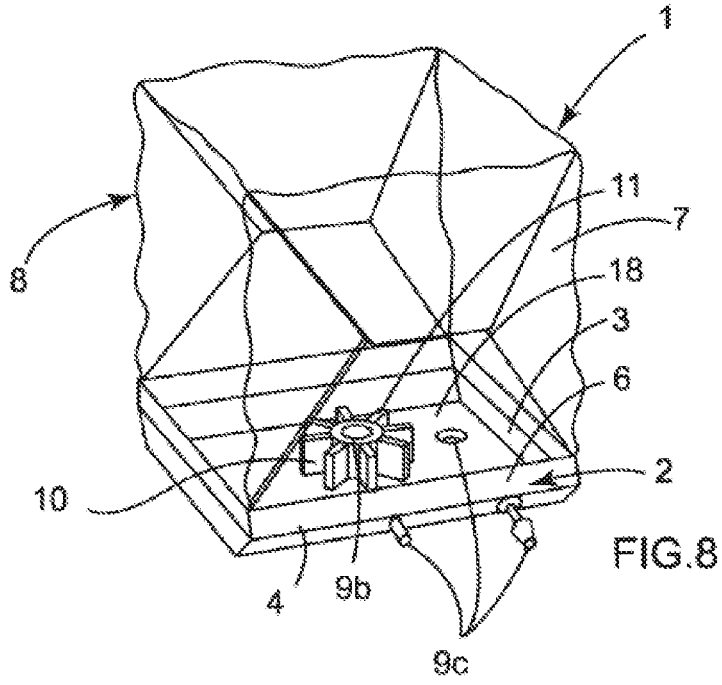
FIGS. 8 and 9 are two views of a variant of the third embodiment of FIG. 5, respectively in perspective and in cutaway by an axial plane, with FIG. 8 showing, on the one hand, on the transverse end wall, a non-pass-through connection port that accommodates an internal element of the functional treatment means, here a mixing element, and an input/output port, on the other hand, on the side wall, two input/output ports, and finally, a receptacle whose side wall, located in the extension of the shell that forms the side wall of the frame, placed at the lower end, is arranged with foldable gussets, expanded here.
Figure 9:
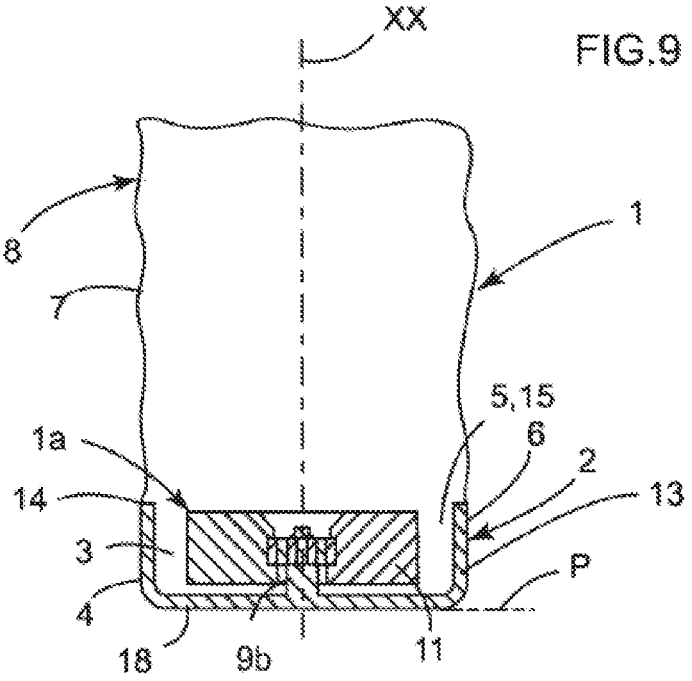

A variant of the third embodiment of FIG. 5, shown in FIGS. 8 and 9, differs from this third embodiment by the following characteristics:

- The frame 2 is placed at the lower end and not at the upper end.
- The transverse end wall 18 of the frame 2 supports or includes a non-pass-through connection port 9*b*, such as a stud, accommodating the internal element 11, in this case a mixing element and also an input/output port 9*c*.
- The non-pass-through connection port 9*b* and the input/output port 9*c* that have just been mentioned extend along an axial direction, in this case vertical.
- The side wall 4 of the frame 2 supports or includes two input/output ports 9*c*.
- The receptacle 8 is arranged with foldable gussets.

Figure 10:
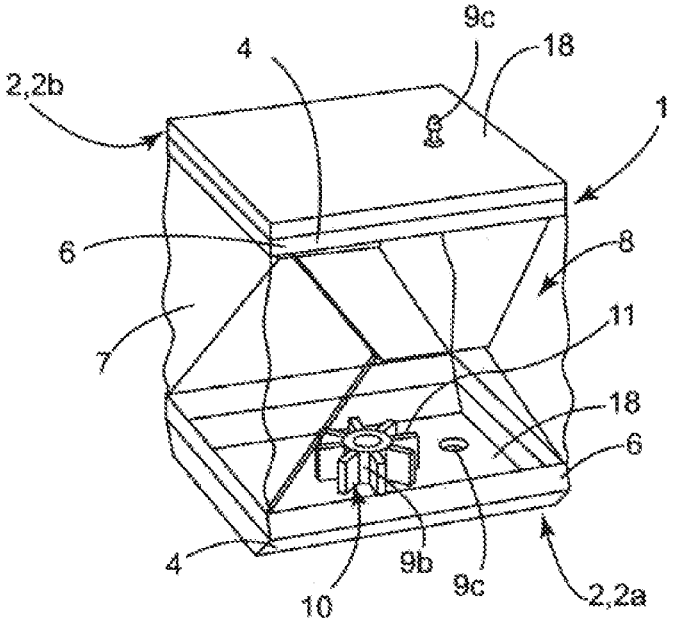
FIGS. 10 and 11 are two views of a variant of the fifth embodiment of FIG. 7, respectively in perspective and in cutaway through an axial plane, whereby
Figure 11:
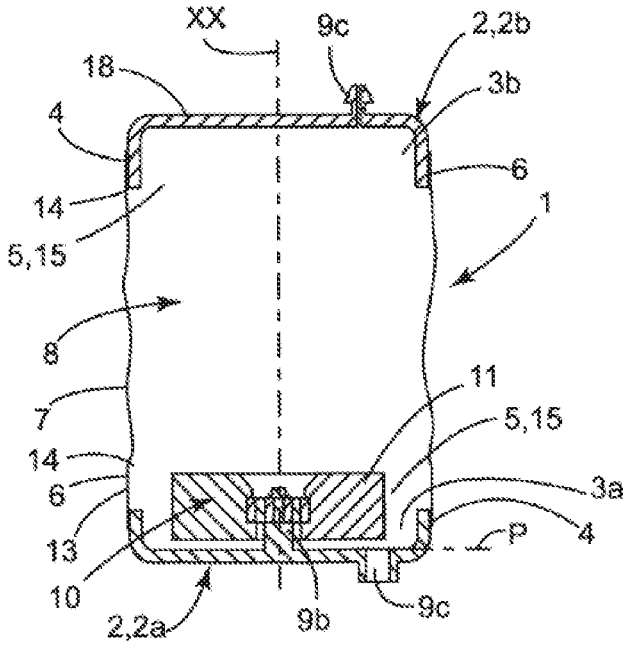

A variant of the fifth embodiment of FIG. 7, shown in FIGS. 10 and 11, differs from this fifth embodiment by the following characteristics:

- The internal element 11 is housed in an inside space (3*a*+3*b*) that is formed by the two inside spaces (3*a* and 3*b*) in relation to the two frames (2*a*, 2*b*) facing one another.
- The transverse end wall 18 of the frame 2*a* that is placed at the lower end supports or includes a non-pass-through connection port 9*b*, such as a stud, accommodating the internal element 11, in this case a mixing element and an input/output port 9*c*.
- The side wall 4 of the frame 2*a* that is placed at the lower end has no ports.
- The transverse end wall 18 of the frame 2*b* that is placed at the upper end supports or includes an input/output port 9*c*.
- The side wall 4 of the frame 2*b* that is placed at the upper end has no ports.

All of the ports—non-pass-through connection ports 9*b* as well as input/output ports 9*c*—extend along an axial direction, in this case vertical.

The receptacle 8 is arranged with foldable gussets.

Figure 12:
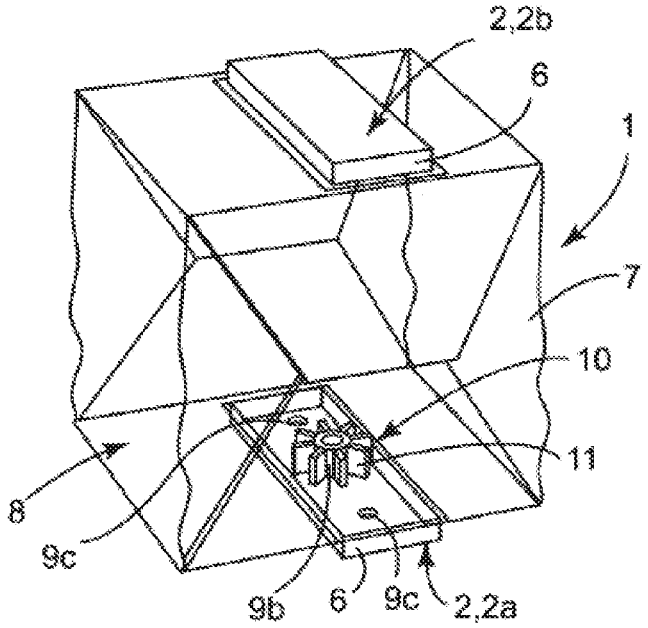
FIGS. 12 and 13 are two views of a variant of the variant of the fifth embodiment of FIGS. 10 and 11, respectively in perspective and in cutaway through an axial plane, whereby
Figure 13:
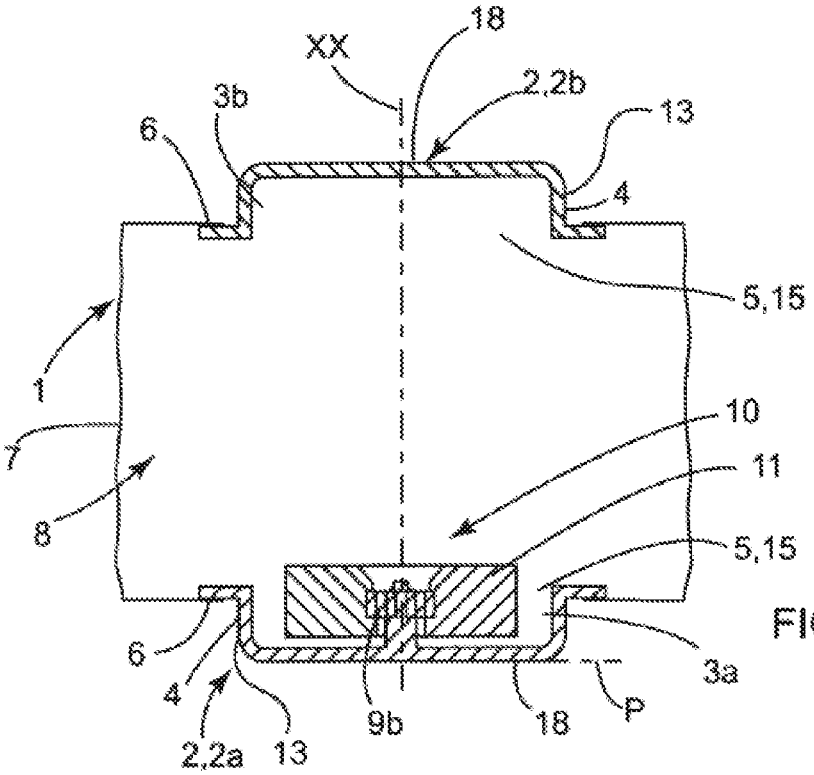
Figure 14:
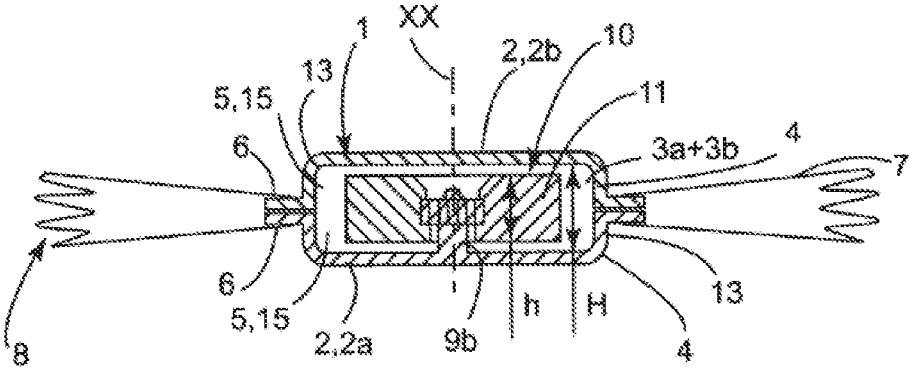
FIG. 14 shows in axial cutaway the receptacle that is shown in FIGS. 12 and 13, with folded gussets, the figure showing that the internal element is housed in an inside space that is formed by the two inside spaces in relation to the two frames facing one another.

A variant of the variant that was just described in relation to the FIGS. 10 and 11 is shown in FIGS. 12, 13, and 14 and differs therefrom by the following characteristics:

The receptacle 8 comprises a side wall 7 that is located transversely apart from the shell that forms the side wall of the frames placed at the lower and upper ends.

The frame 2 that is placed at the lower end comprises two input/output ports.

The frame 2 that is placed at the upper end has no port at all.

The structural arrangement according to which the internal element 11 is housed within an inside space (3*a*+3*b*) that is formed by the two inside spaces (3*a* and 3*b*) in relation to the two frames (2*a*, 2*b*) facing one another makes it possible to take advantage of the presence of a frame 2*a*, 3*b* at each of the two ends of the container 1 while preventing the one 2*a* of the frames with which the internal element 11 is associated from having an axial dimension that is at least equal to that of the internal element 11, with the result of increasing the axial dimension of the folded container 1, as it is shown in FIG. 14. With this structural arrangement, the axial size H to be taken into account is that of the inside space 3*a*+3*b*.

The different embodiments and variants described show the flexibility that the design offers according to the invention and in particular that it is possible to provide not a single frame 2 but several frames 2*a*, 2*b* and that each component part of the frame 2 can be usefully used to support or include a port 9*a*, 9*b* or 9*c*.

The invention also relates to a container 1 as it was just described, including the receptacle(s) 8 that contain(s) one—or more—biopharmaceutical fluids.

The invention also relates to a unit that comprises, on the one hand, a container 1 as it was just described, and, on the other hand, a rigid support (not shown) that can ensure that the container 1 is held.

Such a rigid support comprises, according to a typical embodiment, a lower transverse rigid wall and an erect, side, peripheral, axial, rigid wall, limiting an upper transverse opening for access to a defined housing, the inside surfaces of the side and lower walls, able to accommodate the container 1, the receptacle 8 filled with biopharmaceutical fluid that is applied against these inside surfaces.

Such a rigid support is described in a particular embodiment in the document EP-A-1 012 073.

A container 1 as it was just described can have a volume of between 1 liter and 3,500 liters.

The invention claimed is:

1. A large-capacity container configured to hold fluid contents, the container comprising:

at least one receptacle made of a component film having at least one side wall made of flexible film and having an open free edge, the receptacle being at least partially deformable between two states, a first state being a state in which the receptacle is folded flat for storage as an empty container and a second state being a state in which the receptacle is expanded in volume when the receptacle is filled with contents;

at least one rigid, hollow frame comprising at least one side wall that is closed peripherally on itself to define at least one inside space, the at least one side wall comprising at least one side edge defining a first transverse opening of the hollow frame with which the open free edge of the receptacle side wall is integrated in an airtight manner, and a transverse end wall located opposite the first transverse opening, the first transverse opening being disposed on one side of the side wall and the transverse end wall being disposed on another side of the side wall, the at least one receptacle being located on a side of the frame at which the first transverse opening is located; and at least one functional treatment system configured to treat the contents including at least one internal element disposed inside the container, the functional treatment system including one or more of a mixing system, an aeration system, a measurement system, and a pump system, the internal element including one or more of rods, shafts, propellers, mixing elements, aerators, and pumps, the functional treatment system further including a non-pass-through connection port and an input/output port, supported by or included in the hollow frame, the non-pass-through connection port being configured to hold the internal element of the functional treatment system, the internal element being housed within the inside space defined by the frame side wall when the receptacle is in the first, folded state and when the receptacle is in the second, expanded state, the non-pass-through connection port being located either on the side wall or on the transverse end wall of the hollow frame, wherein, when the receptacle is empty of the contents, the receptacle is configured to be folded flat in the first state and disposed against an adjacent side edge of the frame and outside of the inside space defined by the frame side wall beside one of the first transverse opening and the second transverse opening, the frame side wall is configured as a spacer between the internal element and the component film of the receptacle such that the internal element is configured within the container to avoid damaging the component film of the receptacle in the first, folded state, and the container is configured to constitute a sterile, disposable container with a large capacity, designed for storage, shipping or treatment of biopharmaceutical fluid.

2. The container according to claim 1, wherein the internal element is one of (i) housed in the at least one inside space that is delimited by the frame side wall, an axial size of the frame side wall delimiting the inside space with an axial size that is at least equal to the axial dimension of the internal element, and (ii) when the at least one inside space includes two inside spaces and the at least one hollow frame includes two frames facing one another, housed in a combination inside space that is formed by the two inside spaces opposite the two frames, an axial size of the combination inside space formed by the two inside spaces being at least equal to the axial dimension of the internal element.

3. The container according to claim 1, wherein at least a portion of the side wall of the receptacle is located in one or more of an extension of a shell that forms the side wall of the frame and transversally apart from the shell that forms the side wall of the frame.

4. The container according to claim 1, wherein the side wall of the receptacle is configured in a foldable and expandable accordion shape.

5. The container according to claim 1, wherein the side wall of the receptacle includes foldable and expandable gussets.

6. The container according to claim 1, wherein the transverse end wall is rigid or deformable.

7. The container according to claim 1, wherein the transverse end wall has a rigid bonding or a flexible bonding with the side wall of the frame.

8. The container according to claim 1, wherein the frame is made of plastic.

9. The container according to claim 1, wherein the container is opaque, the functional treatment system being sensitive to light.

10. The container according to claim 1, wherein the receptacle is one of (i) integrally deformable, being made in the form of a pouch made of plastic film, and (ii) partially deformable, being made in the form of a sheath or sleeve made of plastic film, and partially non-deformable, including a rigid part in the form of a plate.

11. The container according to claim 10, wherein the rigid part is located opposite the frame.

12. The container according to claim 1, wherein the at least one receptacle contains one or more biopharmaceutical fluids.

13. A unit comprising:

a container according to claim 1; and a rigid support configured to hold the container.

14. The container according to claim 1, wherein the non-pass-through connection port is a stud.

* * * * *